United States Patent [19]

Koshoji et al.

[11] Patent Number: 4,480,817

[45] Date of Patent: Nov. 6, 1984

[54] SHOCK-ABSORBING WINCH

[75] Inventors: Yoshihiro Koshoji, Tokyo; Kenji Sato, Maizuru, both of Japan

[73] Assignees: Director General, Technical Research and Development Institute, (TRDI) The Defence Agency; Hitachi Zosen Corporation, both of Japan

[21] Appl. No.: 466,072

[22] Filed: Feb. 14, 1983

[30] Foreign Application Priority Data

Feb. 16, 1982 [JP] Japan ..... 57-24234

[51] Int. Cl.[3] ..... B66D 1/00

[52] U.S. Cl. ..... 254/332

[58] Field of Search ..... 254/266, 278, 329, 332, 254/364, 371; 414/138, 139; 464/89, 91, 160, 180

[56] References Cited

U.S. PATENT DOCUMENTS

| | | | |
|---|---|---|---|
| 2,386,086 | 10/1945 | Beebe | 254/266 X |
| 2,891,395 | 6/1959 | Chater | 464/89 X |
| 2,895,714 | 7/1959 | Clark | 254/371 X |
| 3,021,113 | 2/1962 | Kinnison | 254/371 X |
| 3,183,684 | 5/1965 | Zeidler | 464/91 X |

OTHER PUBLICATIONS

Japanese Published Unexamined Utility Model Application No. 57-99889 Discloses a Rope Pressing Assembly Closely Corresponding to the one Discussed on pp. 5 and 6 of the Present Specification.

Japanese Published Unexamined Utility Model Application No. 57-96192 Discloses a Rope Guide Assembly Closely Corresponding to the one Discussed on pp. 4 and 5 of the Present Specification.

*Primary Examiner*—Stuart S. Levy
*Assistant Examiner*—Joseph J. Hail, III
*Attorney, Agent, or Firm*—Barnes, Kisselle, Raisch, Choate, Whittemore & Hulbert

[57] ABSTRACT

A shock-absorbing winch comprising a drive shaft reversibly rotatable by a drive unit and having a cylindrical outer peripheral surface, a hollow winch drum surrounding the drive shaft and forming a cylindrical hollow space therein around the outer peripheral surface of the drive shaft, a first stopper fixed to the outer peripheral surface of the drive shaft at a suitable location in the circumferential direction thereof, a second stopper fixed to the inner peripheral surface of the winch drum at a suitable location in the circumferential direction thereof and dividing the cylindrical space into first and second circular arc compartment between the first and second stoppers, a first shock absorber disposed in the first compartment, and a second shock absorber disposed in the second compartment. Since the winch does not require provision of another shock absorber independently thereof, the winch can be installed without the limitation that would be needed, for example, for rigging a ship.

6 Claims, 5 Drawing Figures

SHOCK-ABSORBING WINCH

The present invention relates to a winch, and more particularly to a winch having incorporated therein shock absorbers for absorbing shocks acting when articles are hoisted.

Conventionally winches are disposed independently of shock absorbers as will be described later with reference to a drawing, so that the shock absorber is likely to become an obstacle, for example, when rigging or fitting out a ship.

Accordingly the main object of the present invention is to provide a winch incorporating shock absorbers in order to overcome such a problem.

To fulfill this object, the present invention provides a shock-absorbing winch comprising a drive shaft reversibly rotatable by a drive unit and having a cylindrical outer peripheral surface, a hollow winch drum surrounding the drive shaft and forming a cylindrical hollow space between the outer peripheral surface of the drive shaft and the inner peripheral surface of the winch drum, a first stopper fixed to the outer peripheral surface of the drive shaft at a suitable location in the circumferential direction thereof, a second stopper fixed to the inner peripheral surface of the winch drum at a suitable location in the circumferential direction thereof and dividing the cylindrical hollow space into first and second circular arc compartments between the first and second stoppers, a first shock absorber disposed in the first compartment, and a second shock absorber disposed in the second compartment.

Various features and advantages of the invention will be readily understood from the following description of an embodiment given with reference to the accompanying drawings, in which.

Before describing an embodiment of the invention, a conventional winch arrangement will be described with reference to FIG. 1.

Figure 1:
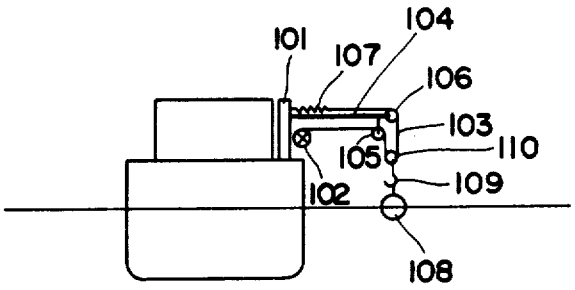
FIG. 1 is a diagram showing a conventional arrangement including a winch.

FIG. 1 shows a post 101 extending upright, for example, from a deck of a ship, and a winch 102 supported by the post 101. A wire rope 103 paid off from the winch 102 is passed over sheaves 105 and 106 rotatably mounted on a support arm 104 secured to the post 101 and has a forward end connected to the post 101 via a shock absorber 107. For example when hoisting an article 108 floating on the sea, a hook 109 attached to a sheave 110 vertically movably supported by the wire rope 103 is engaged with the floating article 108, and the winch 102 is operated to wind up the wire rope 103 and raise the article 108. The shock acting on hoisting is absorbed by the shock absorber 107.

However, the conventional arrangement involves a likelihood that the shock absorber 107, which is provided independently of the winch 102 as already stated, will become an obstacle when rigging the ship.

A winch of the present invention which has overcome this problem will be described below in detail with reference to FIG. 2 to FIG. 5.

Figure 2:
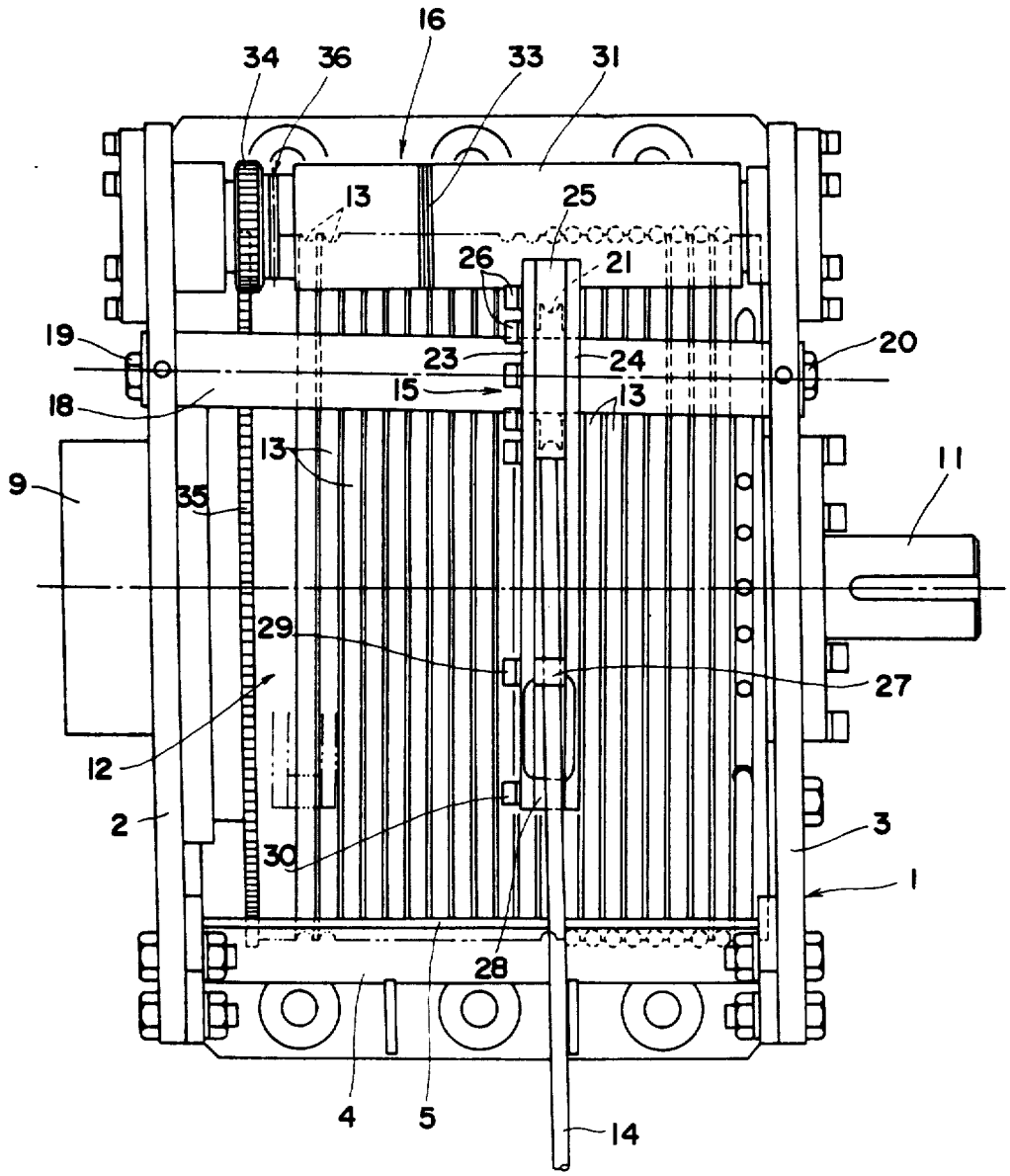
FIG. 2 is a front view showing a winch embodying the present invention.
Figure 3:
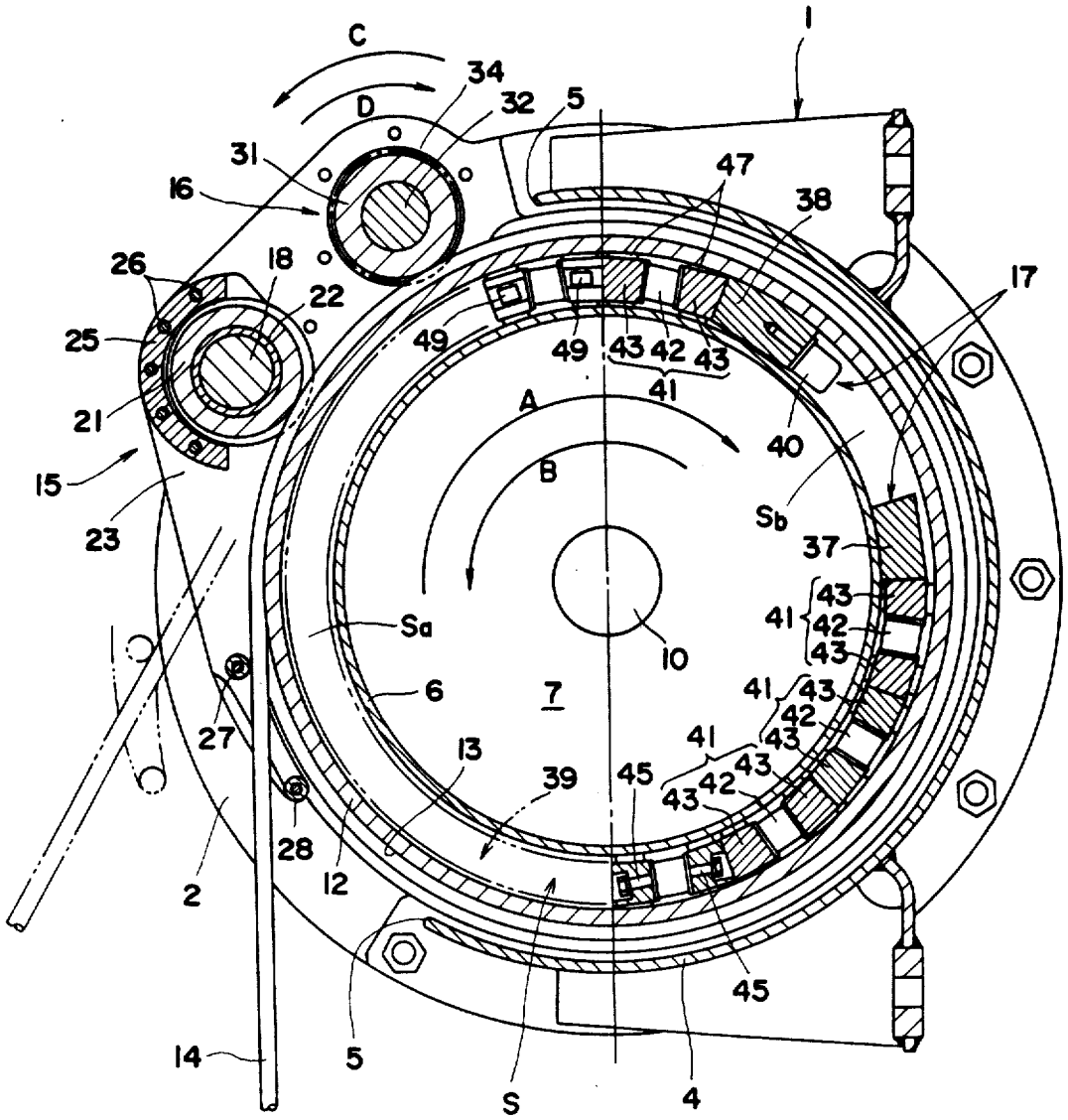
FIG. 3 is a side elevation in transverse section showing the same.

FIGS. 2 and 3 show a winch frame structure 1 comprising a pair of side plates 2 and 3, and a circular arc plate 4 connected between the side plates 2 and 3 and having front opening edges 5. A hollow drive shaft 6 having flange disks 7 and 8 attached to its axially opposite ends (FIGS. 3 and 4) is provided between the side plates 2 and 3. The flange disk 7 is fixed to the output shaft 10 of a drive unit 9, which reversibly rotates the drive shaft 6 as indicated by arrows A and B. The other flange disk 8 is fixedly provided with the output shaft 11 of the winch. The output shaft 11 is connected to another winch to deliver power thereto. Further provided between the side plates 2 and 3 is a hollow winch drum 12 surrounding the drive shaft 6 and spaced therefrom by a predetermined distance to form a cylindrical space S between the outer peripheral surface of the drive shaft 6 and the inner peripheral surface of the winch drum 12. The winch drum 12 is formed in its outer peripheral surface with a helical rope guide groove 13 for a wire rope 14 to fit in. In addition to the foregoing components, the winch generally comprises a rope guide assembly 15, a rope pressing assembly 16 and a shock absorbing assembly 17.

The rope guide assembly 15 comprises a guide shaft 18 opposed to the winch drum 12 in front thereof and positioned above the axis of the drum 12. The axis of the guide shaft 18 extends approximately at right angles to the rope guide groove 13 and is therefore slightly inclined with respect to the drum axis. The guide shaft 18 has its opposite ends fixed to the side plates 2 and 3 by bolts 19 and 20. A guide sheave 21 is mounted by a bearing 22 on the guide shaft 18 rotatably and axially slidably. The sheave 21 has outer peripheral edges which are fittable in the rope guide groove 13. A pair of side plates 23 and 24 are rotatably mounted, each at its one end (upper end), on the guide shaft 18, with the sheave positioned between the side plates. The side plates 23 and 24 are slidable on the shaft 18 axially thereof and are connected together by a spacer 25 and bolts 26. A pair of upper and lower guide rollers 27 and 28 (which are in front and rear positions respectively) are rotatably mounted on the side plates 23 and 24 by bolts 29 and 30 and disposed between the other ends (lower ends) of the plates. In accordance with the direction in which the wire rope 14 is wound up, the side plates 23 and 24 are rotatable independently of the sheave 21 as indicated in solid lines and phantom lines in FIG. 3.

The rope pressing assembly 16 comprises a pressure roll shaft 32 positioned above the rope guide assembly 15, opposed to the upper opening edge 5 of the circular arc plate 4 and supported at its opposite ends by the side plates 2 and 3, and a pressure roll 31 rotatably mounted on the shaft 32. The pressure roll 31 has an outer peripheral surface spaced apart from the outer peripheral surface of the winch drum 12 by a predetermined small distance and formed with a thread 33 the helix of which is reverse to, and has a smaller pitch than, the helix of the rope guide groove 13. A driven gear 34 is rotatably mounted on the pressure roll shaft 32 and is in mesh with a drive gear 35 fixed to one end of the winch drum 12. The driven gear 34 has a smaller number of teeth than the drive gear 35. Ratchet means 36 is provided between the driven gear 34 and the pressure roll 31, such that only when the drive gear 34 is rotated in the direction of arrow D, a ratchet engages the gear to cause the pressure roll 31 to rotate in the same direction.

Figure 4:
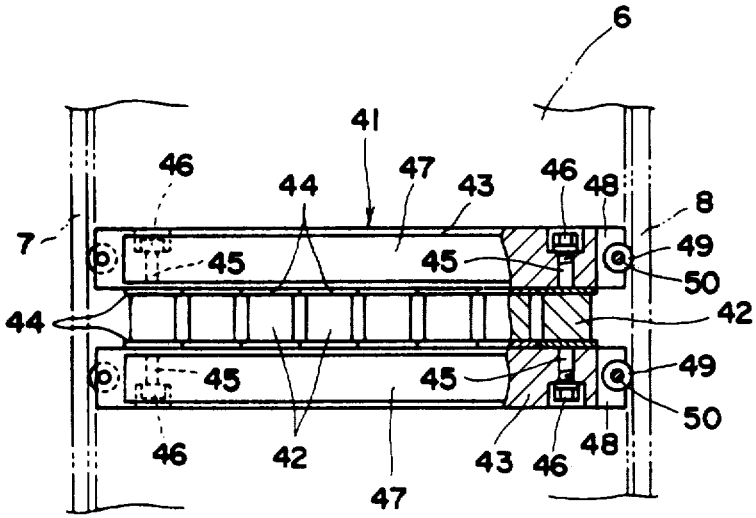
FIG. 4 is a fragmentary view in section showing a shock absorber of the winch.
Figure 5:
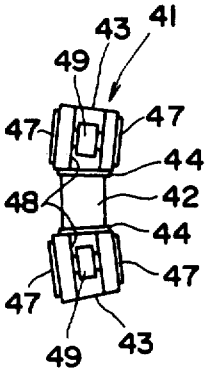
FIG. 5 is a view showing the shock absorber as it is seen in the direction of arrows X—X in FIG. 4.

The shock absorbing assembly 17 comprises a first stopper 37 fixed as by bolting to the outer peripheral surface of the hollow drive shaft 6 at a suitable location in the circumferential direction thereof, and a second stopper 38 fixed as by bolting to the inner peripheral surface of the winch drum 12 at a suitable location in the circumferential direction thereof. Accordingly the cylindrical space S formed between the hollow drive shaft 6 and the winch drum 12 is divided by these two stoppers 37 and 38 into a first compartment Sa and a second compartment Sb. A first shock absorber 39 is disposed in the first compartment Sa, and a second shock absorber 40 in the second compartment Sb. The second shock absorber 40 comprises a rubber piece which is bolted, for example, to one side of the second stopper 38. The first shock absorber 39 comprises a plurality of (e.g. fourteen in the present embodiment) buffer members 41 each extending axially of the drive shaft 6 and arranged circumferentially of the shaft 6. As seen in FIG. 4, each of the buffer members 41 chiefly comprises a plurality of (e.g. eight in the present embodiment) rubber pieces 42 arranged at a suitable spacing axially of the drive shaft 6, and a pair of retainer bars 43 fixedly holding the rubber pieces 42 on circumferentially opposite sides thereof. The rubber pieces 42 are connected to the retainer bars 43 by securing a metal plate 44 having a bolt 45 to each of the circumferentially opposite sides of each rubber piece 42, inserting the bolt 45 through a hole formed in the retainer bar 43 and corresponding thereto, and screwing a nut 46 on the bolt. As shown in FIG. 5, a slide sheet 47 of ethylene tetrafluoride resin incorporating glass cloth is affixed to each of radially opposite sides of each retainer bar 43 to render the bar 43 smoothly slidable on the outer peripheral surface of the drive shaft 6 and the inner peripheral surface of the winch drum 12 without seizure. A recess 48 is formed in each of the longitudinal ends of the retainer bar 43, and a roller 49 rotatably supported by a pin 50 is accommodated in the recess 48. These rollers 49 are adapted for contact with the flange disks 7 and 8 at opposite ends of the drive shaft 6. The cylindrical space S is filled with grease. The rubber pieces 40 and 42 may of course be replaced by other elastic members, such as springs. A shock absorber similar to the first shock absorber 39 is usable as the second shock absorber 40.

To wind up the wire rope 14 as attached to a load, the hollow drive shaft 6 is rotated by the drive unit 9 in the direction of arrow A. This revolves the first stopper 37 in the same direction, rotating the winch drum 12 in the same direction through the first shock absorber 39 and the second stopper 38, whereby the wire rope 14 is wound up. The shock produced upon the start of the winding operation is absorbed by the first shock absorber 39. Although the rotation of the winch drum 12 in the direction of arrow A causes the drive gear 35 to rotate the driven gear 34 in the direction of arrow C, the ratchet means 36 remains inoperative, so that the pressure roller 31 will not be rotated positively, permitting the wire rope 14 to be wound up with low resistance. Even if unloaded, the wire rope 14 can be wound up without slackening. Since the outer peripheral edges of the rope guide sheave 21 which is movable along the guide shaft 18 fit in the rope guide groove 13, the wire rope 14 held in the groove 13 by the sheave 21 can be wound up properly along the rope guide groove 13. Further even when the direction in which the wire rope 14 is wound up changes from the vertically upward direction shown in solid lines in FIG. 3 to an oblique direction indicated in phantom lines, the side plates 23 and 24 rotate about the guide shaft 18 to accommodate the change.

When the wire rope 14 is to be paid off, the hollow drive shaft 6 is rotated by the drive unit 9 in the direction of arrow B, whereupon the first stopper 37 is revolved also in the same direction and brought into contact with the second shock absorber 40, whereby the shock is mitigated. The winch drum 12 is thereafter rotated in the same direction through the second stopper 38 to pay off the wire rope 14. The rotation of the winch drum 12 in the direction of arrow B causes the drive gear 35 to rotate the driven gear 34 in the direction of arrow D, further rotating the pressure roller 31 also in the same direction through the ratchet means 36. The pressure roller 31 is rotated at a slightly higher circumferential speed than the wire rope 14. Consequently the wire rope 14 is subjected to a force acting in the direction of paying off and exerted by the friction between the roller 31 and the rope 14 and is therefore paid off without slackening even if unloaded. Further because the helix of the thread 33 on the pressure roller 31 is reverse to the helix of the helical rope guide groove 13 in the winch drum 12, the thread is effective for reducing the axial thrust acting on the pressure roller 31.

Whereas the shock absorber provided for the conventional winch independently thereof imposes a limitation on the winch arrangement, the present invention chiefly contemplates elimination of such a limitation by incorporating shock absorbers in a winch itself. Accordingly the rope guide assembly or the rope pressing assembly need not always be provided; such an assembly can be installed or omitted suitably according to the requirements for the use of the winch.

What is claimed is:

1. A shock-absorbing winch comprising a drive shaft reversibly rotatable by a drive unit and having a cylindrical outer peripheral surface, a hollow winch drum surrounding the drive shaft and forming a cylindrical space between the outer peripheral surface of the drive shaft and the inner peripheral surface of the drum, a first stopper fixed to the outer peripheral surface of the drive shaft at a suitable location in the circumferential direction thereof, a second stopper fixed to the inner peripheral surface of the winch drum at a suitable location in the circumferential direction thereof and dividing the cylindrical space into first and second circular arc compartments between the first and second stoppers, a first shock absorber disposed in the first compartment, and a second shock absorber disposed in the second compartment; wherein the first shock absorber comprises a plurality of elastic means each extending axially of the drive shaft and arranged circumferentially of the drive shaft, each of the elastic means is fixedly held between a pair of retainer bars spaced apart circumferentially of the drive shaft, and each of the retainer bars is provided with slide sheets spaced apart radially of the drive shaft and individually in contact with the outer peripheral surface of the drive shaft and the inner peripheral surface of the winch drum.

2. A winch as defined in claim 1 wherein each of the elastic means comprises a plurality of elastic members arranged at a spacing axially of the drive shaft.

3. A winch as defined in claim 1 wherein the second shock absorber comprises an elastic member attached to one of the first and second stoppers.

4. A shock-absorbing winch comprising a drive shaft reversibly rotatable by a drive unit and having a cylindrical outer peripheral surface, a hollow winch drum surrounding the drive shaft and forming a cylindrical space between the outer peripheral surface of the drive shaft and the inner peripheral surface of the drum, a first stopper fixed to the outer peripheral surface of the drive shaft at a suitable location in the circumferential direction thereof, a second stopper fixed to the inner peripheral surface of the winch drum at a suitable location in the circumferential direction thereof and dividing the cylindrical space into first and second circular arc compartments between the first and second stoppers, a first shock absorber disposed in the first compartment, and a second shock absorber disposed in the second compartment; wherein the first shock absorber comprises a plurality of elastic means each extending axially of the drive shaft and arranged circumferentially of the drive shaft, each of the elastic means is fixedly held between a pair of retainer bars spaced apart circumferentially of the drive shaft, a flange disk is attached to each of the axially opposite ends of the drive shaft, and a roller guidable by the flange disk in contact therewith is mounted on each of the retainer bars at each of its ends which are opposite axially of the drive shaft.

5. A winch as defined in claim 4 wherein each of the elastic means comprises a plurality of elastic members arranged at a spacing axially of the drive shaft.

6. A winch as defined in claim 4 wherein the second shock absorber comprises an elastic member attached to one of the first and second stoppers.

* * * * *